United States Patent [19]

Kelly

[11] Patent Number: 4,483,310

[45] Date of Patent: Nov. 20, 1984

[54] HEAT EXCHANGER

[76] Inventor: James Kelly, Rte. 45 and Nebraska St., Frankfort, Ill. 60423

[21] Appl. No.: 395,374

[22] Filed: Jul. 6, 1982

[51] Int. Cl.[3] ..... F24C 13/00

[52] U.S. Cl. ..... 126/35; 126/362; 237/19; 165/DIG. 12; 122/20 B

[58] Field of Search ..... 126/427, 53, 362, 34, 126/35; 237/8 R, 8 C, 19, 1 R; 165/DIG. 12; 122/20 B

[56] References Cited

U.S. PATENT DOCUMENTS 4,350,144 9/1982 Beckwith ..... 126/427
4,374,506 2/1983 Whalen ..... 122/20 B

FOREIGN PATENT DOCUMENTS 2712733 9/1978 Fed. Rep. of Germany ..... 126/427

*Primary Examiner*—Henry Bennett
*Attorney, Agent, or Firm*—Ernest Kettelson

[57] ABSTRACT

A heat exchanger comprising a coil assembly mounted in a broiler used in restaurants for example where the temperature of the broiler is about 500° F., such coil assembly being connected to an intermediate holding tank into which cold water is fed from a public water supply through a downwardly extending pipe in the intermediate holding tank having its discharge opening near the bottom of the tank. An outlet port is located slightly above the level of the discharge opening of the downwardly extending pipe, and a conduit is connected between the outlet port of the holding tank and the coil assembly mounted in the broiler, with a pump connected in this conduit to pump cold water from the bottom portion of the intermediate holding tank to the coil assembly mounted in the broiler. A return conduit leads from the coil assembly back to an inlet port of the intermediate holding tank located in the upper part of such tank whereby water which has been heated to about 100° F. from about 40° F. before reaching the coil assembly is returned to the upper portion of the intermediate holding tank. The upper one-half to two-thirds of the intermediate holding tank thereby contains heated water up to 100° F. while the lower one-third has relatively colder water about 40° F. coming in from the public water supply ready to be pumped out of the bottom outlet port to the heat exchanger coil to be heated.

4 Claims, 5 Drawing Figures

HEAT EXCHANGER

BACKGROUND OF THE INVENTION

This invention relates to the field of heat exchangers in which heat from an existing source is utilized to heat water or other fluid which is then utilized for some other heating purposes.

One of the problems with prior art devices of this kind is the heat loss at the heat generating source which results from cold water or other cold fluid being piped into the vicinity of the heat source which reduces the heat needed for its primary purpose or function. For example, heat exchanger coils in a kitchen range used for cooking or baking will draw heat away from the primary cooking and baking function of the range if a portion of the heat is constantly needed to raise the temperature of the fluid flowing in the heat exchanger coils. In accordance with the present invention this problem in large part is overcome by providing an intermediate holding tank in which the water temperature has not been raised to its final end use level so less heat is taken up by the heat exchanger coils to reach that intermediate temperature. Also the unheated water from the public water supply is first fed into the intermediate holding tank which contains already heated water in the upper portion. The temperature of the incoming water from the public water supply is therefore raised somewhat before being fed through the heat exchanger coils, all of which tends to reduce the heat loss taken away from the primary purpose for which the heat source is originally provided. The temperature of the water after flowing through the heat exchanger coils in accordance with this invention is not raised to the high level needed for a particular purpose, such as hot water for washing dishes, bathing and the like, as it normally flows from a hot water faucet, but the temperature of the water is raised to an intermediate level and then fed to a normal hot water heater which completes the heating process raising the temperature to whatever level desired. The same principle can be applied to heated water furnished for other purposes such as adding to a hot water heating system for a building and the like.

Examples of prior art devices which have some of the disadvantages and problems solved by the present invention include U.S. Pat. No. 4,250,864 disclosing a heat exchanger which also functions as a grate for a stove. The grate comprises an arrangement of tubing through which a fluid is directed which enters the heat exchanger directly from an outside source rather than from an intermediate holding tank. U.S. Pat. No. 4,048,962 discloses a heat exchanger comprising a water tank in which three pipes or tubes extend through the water tank carrying smoke from a furnace as it passes from the furnace to a chimney for eventual discharge. U.S. Pat. No. 4,046,189 discloses a hot water heater which heats the water by circulating steam or high temperature water from another source through the tank thereby heating cold water which is drawn in from an external source. The purpose of the invention disclosed in that patent is to provide relatively instantaneous hot water without requiring a large holding tank.

U.S. Pat. No. 3,672,444 discloses a water heating system in which cold water is supplied to a holding tank with a shroud extending into the holding tank having tubing within the shroud connecting to an external source of heat such as steam or hot water. The cold water in the holding tank comes in contact with the heated tubing and is heated in that manner for eventual discharge as hot water. U.S. Pat. No. 2,743,718 discloses a kitchen range in which heating coils are provided to take up heat from the range for the purpose of heating water stored in the reservoir in the range cabinet itself. U.S. Pat. No. 2,095,052 discloses a stove for cooking which has pipes extending into the heating area for the purpose of heating water which is then directed elsewhere for use. U.S. Pat. No. 914,085 discloses a heating range in which cold water is drawn from a city supply source into a chamber connected to the range. The cold water is heated from heat generated by the range after which it is directed to a hot water system for the house. None of the foregoing examples of heat exchangers known to the prior art include the feature of an intermediate holding tank in which cold water from an external source is flowed into an intermediate holding tank having partially heated water already stored therein before being fed to the heat exchanger coils. Neither do such prior art devices disclose the idea of returning heated water from the heat exchanger coils to an intermediate holding tank for subsequent delivery to a main hot water heating device of some kind. Less heat is thereby diverted from the heat exchanger coils in accordance with this invention since its purpose is as a booster to partially raise the temperature of the water rather than attempt to raise it completely to the level needed for a particular end use by means of the heat exchanger coils alone.

SUMMARY OF THE INVENTION

It is an object of the invention to provide a heat exchanger comprising a coil mounted in the proximity of a broiler connected to an intermediate holding tank into which unheated fluid from an external source flows before being pumped through the heat exchanger coils and back to the intermediate holding tank after being heated.

It is an object of the invention to provide a heat exchanger in which fluid is partially heated before being directed to heating coils which in turn only partially heat the fluid to the temperature intended for an end use.

It is an object of the invention to provide a heat exchanger comprising an intermediate holding tank, a downwardly extending pipe in said tank having a discharge opening near the bottom thereof said downwardly extending pipe being connected to a public water supply, an outlet port of said intermediate holding tank slightly above said discharge opening connected to conduit leading to heating coils mounted in the proximity of a broiler, a return inlet port in the upper portion of said holding tank connected to conduit leading to the heating coils for return of heated water to the holding tank, an outlet port in the top portion of the holding tank connected to conduit leading to a hot water heater to flow pre-heated water from said holding tank to said hot water heater as hot water is drawn from the latter.

It is an object of the invention to provide a heat exchanger which diverts minimum heat from the primary heating source resulting in minimum heat loss for the main purpose of the primary heating source.

DESCRIPTION OF THE PREFERRED EMBODIMENT

Figure 1:
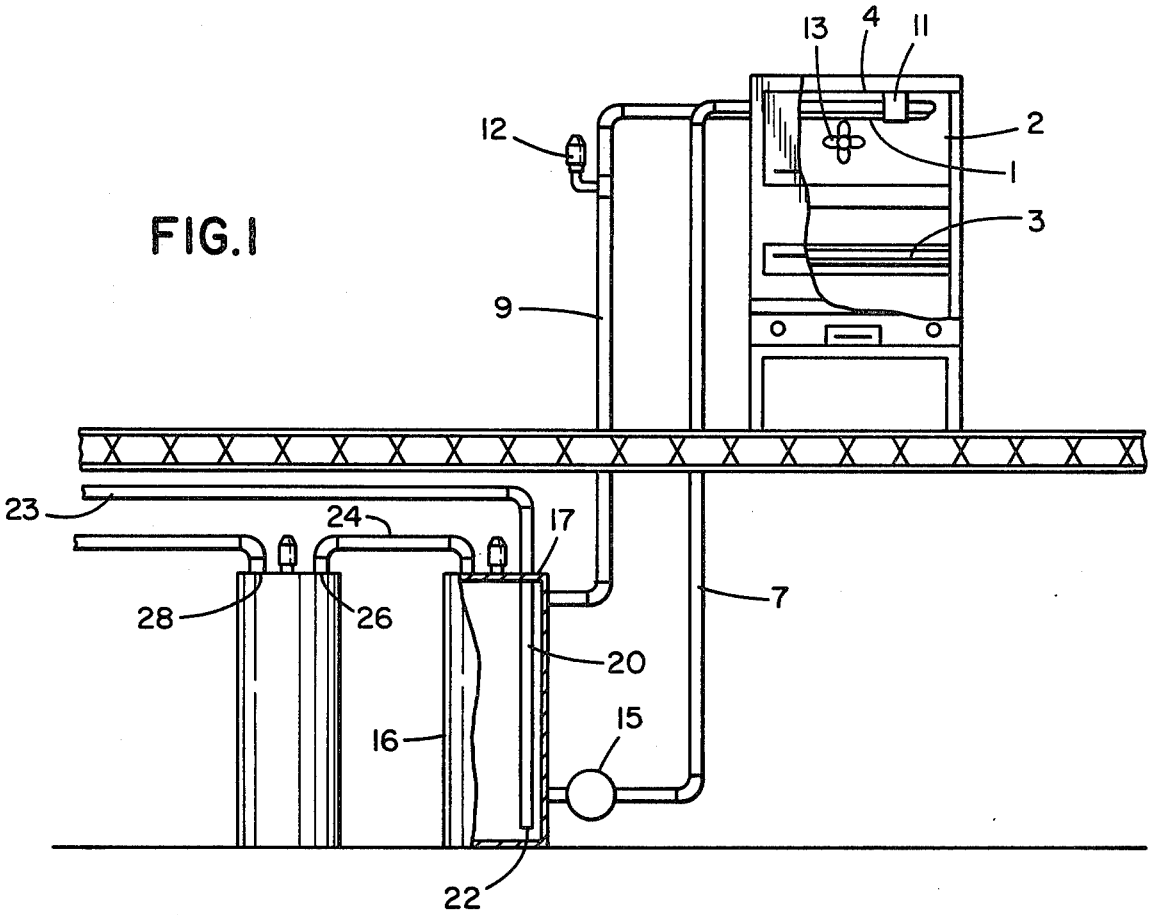
FIG. 1 is a side elevation view of the heat exchanger apparatus in accordance with this invention, including the coil assembly mounted in a warming oven whose side wall is partially broken away, the intermediate holding tank and hot water heater together with the connecting conduits associated therewith.
Figure 2:
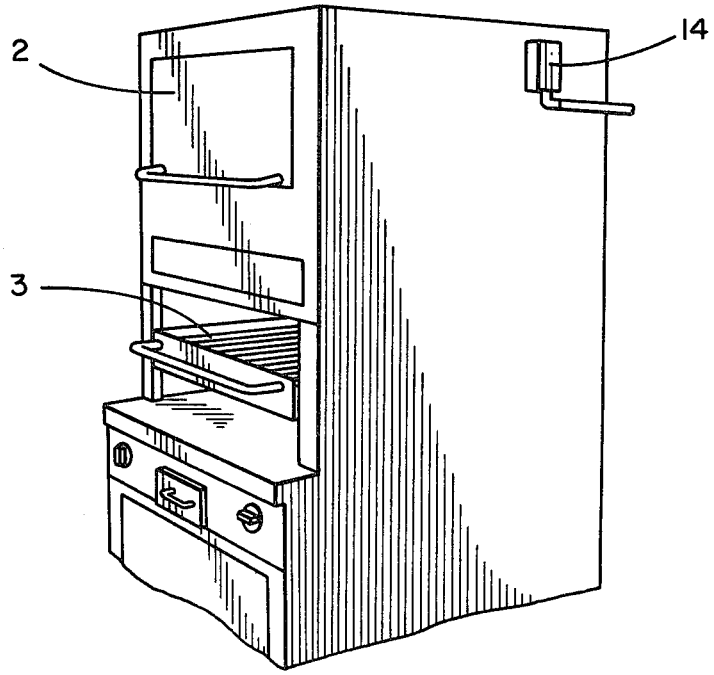
FIG. 2 is a perspective view of a restaurant type broiler and warming oven in which the coil assembly in accordance with this invention is mounted.
Figure 3:
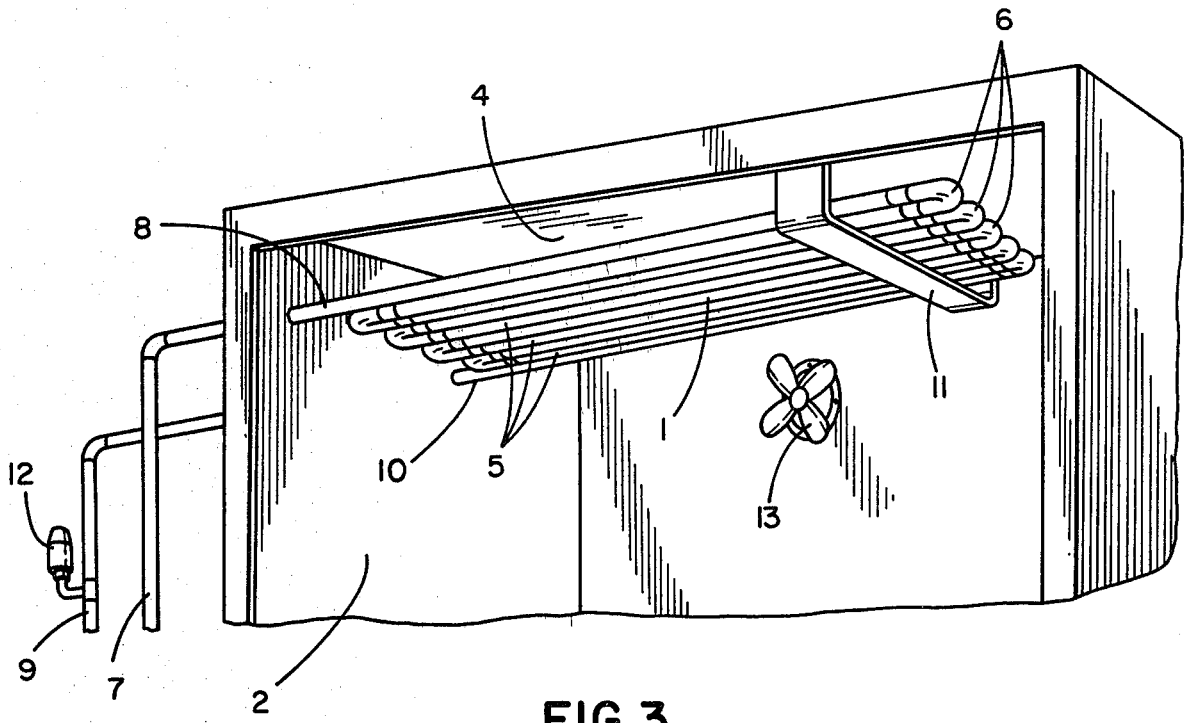
FIG. 3 is a perspective view of the interior of the warming oven shown in FIG. 2 showing the coil assembly mounted therein.
Figure 4:
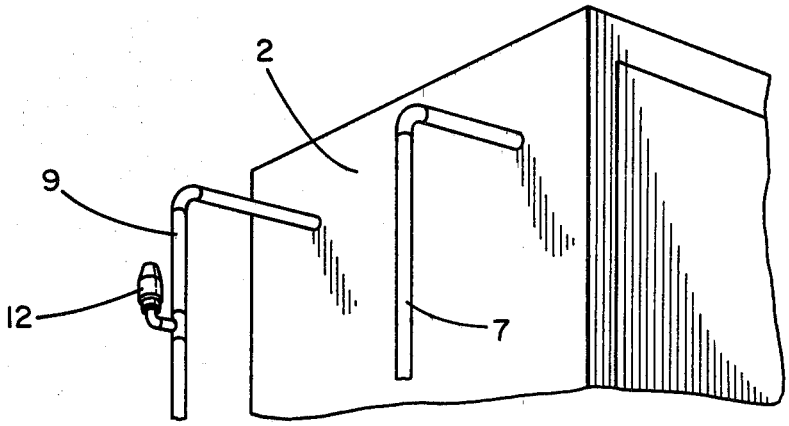
FIG. 4 is a perspective view of the back wall of the warming oven showing the supply conduit leading to the coil assembly mounted within the warming oven, the return conduit leading from the coil assembly, and the pressure control valve installed in the return conduit.
Figure 5:
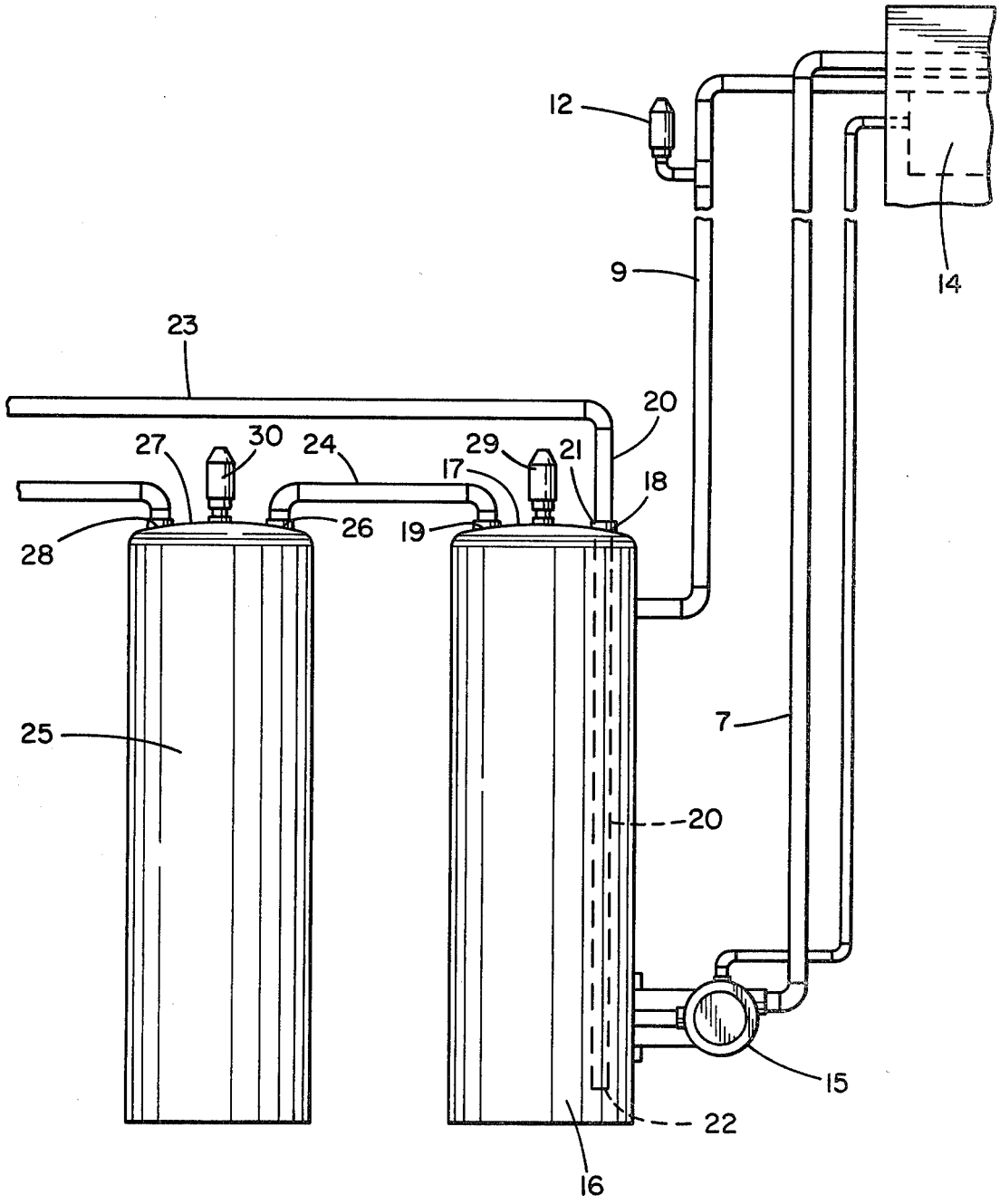
FIG. 5 is a side elevation view of the intermediate holding tank and hot water heater with their connecting conduits, and showing the circulating pump connected in the supply conduit leading to the coil assembly mounted in the warming oven.

A heat exchanger in accordance with this invention includes a coil assembly 1 installed in a warming oven 2 of a broiler 3 of the kind typically used in restaurants. The coil assembly 1 is mounted in the warming oven 2 in the upper portion thereof extending in a horizontal plane substantially parallel to the roof 4 of the warming oven 2 and spaced apart downwardly therefrom a short distance.

The coil assembly comprises a series of tubes or conduits 5 arranged in closely spaced apart, side-by-side relationship joined at each end by U-shaped connecting conduit members to provide a continuous through passageway for water or other liquid or fluid to circulate. One end of the coil assembly 1 is connected to a supply conduit 7 on the upstream side 8 of the coil assembly 1. The other end of the coil assembly 1 is connected to a return conduit 9 on the downstream side 10 of the coil assembly 1. The coil assembly 1 is held in position within the upper portion of warming oven 2 by a mounting bracket 11.

The temperature of the broiler 3 when operating is about 500° F. The broiler 3 is positioned below the warming oven 2 whereby the heat from the broiler extends into the warming oven 2 thereby heating the water or other liquid or fluid circulating within the coil assembly 1. A pressure safety valve 12 is provided in the return conduit 9 which opens to the atmosphere to relieve pressure within the coil assembly 1 and its related circulating conduit assembly when the pressure reaches 150 pounds per square inch or a temperature of 210° F. The safety valve 12 remains closed when the pressure within the return conduit 9 remains below 150 pounds per square inch and 210° F.

A circulating fan 13 may be mounted within the warming oven 2 to direct heated air onto the coil assembly 1. Operation of the fan 13 is controlled by a temperature-sensitive control switch 14 which closes an electrical energizing circuit to power the circulating fan when temperature within the warming oven 2 reaches 150° F. At the end of the day after the broiler has been turned off and temperature in the warming oven drops to 90° F., the temperature-sensitive control switch 14 opens the electrical energizing circuit thereby shutting off the circulating fan 13. A circulating pump 15 is also connected in the same electrical energizing circuit whereby it becomes energized and begins operating when temperature in the warming oven 2 reaches 150° F. and is de-energized and stops operation when temperature in the warming oven drops below 90° F. The circulating pump 15 is connected in the supply conduit 7 which extends from an intermediate holding tank 16 to which it is connected on the upstream side and the coil assembly 1 to which it is connected on the downstream side of the supply conduit 7 which is the upstream side of coil assembly 1.

The return conduit 9 which is connected at one end to the downstream side of coil assembly 1 is connected at its other end to the upper portion of intermediate holding tank 16. The supply conduit 7 is connected to the intermediate holding tank 16 at the lower portion of the tank.

The intermediate holding tank extends vertically and has a capacity of approximately 40 gallons of water or other liquid or fluid, which capacity may vary. The top 17 of the intermediate holding tank includes an inlet port 18 and an outlet port 19. A vertically extending inlet pipe 20 extends through the inlet port 18 and is secured in place by a connector 21. The vertical inlet pipe 20 extends downwardly into the intermediate holding tank 16 and terminates near the bottom thereof at a discharge opening 22. The other end of the inlet pipe 20 extends above the top 17 of intermediate holding tank 16 and is connected to a supply line 23 leading from a city water supply or other pressurized source of cold water. Other liquids or fluids may also be used in accordance with this invention.

A transfer conduit 24 leads from the intermediate holding tank 16 to a conventional water heater 25 of the typical 40 gallon size, one end of the transfer conduit 24 being connected to the outlet port 19 at the top 17 of intermediate holding tank 16, the other end of transfer conduit 24 being connected to an inlet port 26 in the top 27 of the water heater 25. An outlet port 28 is also provided in the top of the water heater 25, a hot water feeder line being connected to the outlet port 28 to supply hot water to the hot water faucets of the restaurant or other building in which the heat exchanger in accordance with this invention is installed.

The intermediate holding tank 16 includes a safety valve 29 to open if pressure builds up to a dangerous level within the intermediate holding tank. The hot water heater 25 also includes a safety valve 30 for the same purpose.

In operation, the broiler 3 is turned on in the morning generating heat which reaches the warming oven 2 in which the coil assembly 1 is mounted. When the temperature within the warming oven 2 reaches 150° F., the temperaturesensitive control switch 14 closes the electrical energizing circuit which starts operation of the circulating fan 13 mounted in the warming oven 2 and also starts the circulating pump 15 which is connected in the supply conduit 7 extending from intermediate holding tank 16 to the upstream side 8 of coil assembly 1. At this time water begins to circulate from the lower portion of intermediate holding tank 16 through the supply conduit 7 and into the coil assembly 1, then past the downstream side of coil assembly 1 into the return conduit 9 back to the intermediate holding tank 16, entering the intermediate holding tank at the upper portion thereof.

As the water circulates through the coil assembly 1 it becomes heated by the heated air in the warming oven directed onto the coil assembly 1 by the circulating fan 13. The circulating pump 15 continues to operate as long as the temperature in the warming oven 2 is above the operative temperature of 150° F. at which temperature the control switch 14 closes the electrical energizing circuit. By continuing to circulate the water through coil assembly 1, excessive temperature build up is avoided, and excessive absorbtion of heat from the warming oven is also avoided so the heat loss or temperature drop within the warming oven 2 as a result of the coil assembly 1 being mounted therein is minimal. In other words, the temperature drop within the warming oven 2 does not in any interfere with the primary purpose of the warming oven, namely to maintain a sufficiently high temperature to keep food, for example, hot while it is waiting to be served.

The water temperature as it leaves the coil assembly 1 and enters the return conduit 9 reaches approximately the 200° F. level. If the water temperature at this point reaches 210° F. or if the pressure exceeds 150 pounds per square inch at this location, the safety valve 12 will open to relieve such pressure.

The water which is pumped from the lower portion of intermediate holding tank 16 is relatively colder than the water in the upper portion of the intermediate holding tank 16 as it returns from the coil assembly 1 after having been heated. There is, of course, some heat transfer from the heated water entering the upper portion of intermediate holding tank 16 downwardly through the intermediate holding tank 16 to the lower portion where the supply conduit 7 is connected leading back to the coil assembly 1. However, the hottest water is always in the upper portion of the intermediate holding tank 16. When someone opens a hot water faucet which draws water from the hot water heater 25, pressure within the hot water heater drops below the pressure within the intermediate holding tank 16 thereby causing heated water to flow from the upper portion of the intermediate holding tank 16 through the transfer conduit 24 into the hot water heater 25 until it is refilled and pressure within the water heater 25 and intermediate holding tank 16 reaches equilibrium. The pressure within intermediate holding tank 16 and water heater 25 is in equilibrium when both are filled. The pressure within intermediate holding tank 16 when filled is in equilibrium with the pressure in the external pressurized water supply source, so no fresh cold water is able to enter the intermediate holding tank 16 until some water has been drawn out of the intermediate holding tank 16 and transferred to the hot water heater 25. When fresh cold water does enter the intermediate holding tank 16 through the discharge opening 22 of inlet pipe 20, being discharged into the lower portion of intermediate holding tank 16, such relatively colder water is promptly pumped through the supply conduit 7 to the coil assembly 1 where it is heated and returned to the upper portion of intermediate holding tank 16 through the return conduit 9.

Since the water which is transferred from the intermediate holding tank 16 to the hot water heater 25 is drawn from the upper portion of the intermediate holding tank 16 where the water is hottest, the water transferred to the hot water heater 25 is at a relatively high temperature. Therefore, the water which is drawn into the hot water heater 25 to replenish and refill the water heater after a quantity of hot water has been drawn out is at a relatively high temperature. The heating mechanism of the hot water 25, therefore, has to do very little work and use very little energy to maintain the temperature of the water within the hot water heater 25 at the desired temperature.

The water within the intermediate holding tank in the upper portion thereof can be maintained at the temperature from 100° F. to a higher temperature if desired, but no greater than about 200° F. to avoid conversion to steam and undue pressure build up within the system. The temperature of the water within the intermediate holding tank 16 can be controlled by controlling the flow rate of water through the supply conduit 7, coil assembly 1 and return conduit 9, which flow return can be controlled by controlling the operating velocity of the circulating pump 15. The temperature can also be controlled by controlling the velocity of the circulating fan 13 as well as by varying the temperature within the warming oven 2. The surface area of the coil assembly 1 may also be made larger or smaller depending on the temperature desired for the water in the intermediate holding tank 16. The smaller the surface area of the coil assembly 1, the lower the water temperature and the larger the surface area, the higher the water temperature in the intermediate holding tank 16. A typical installation as illustrated in the drawing includes ten 1" diameter pipes 16" in length spaced apart in side-by-side relationship across a span of approximately 12" width.

At the end of the day when the broiler 3 is turned off and temperature within the warming oven 2 drops below 90° F., or other appropriate shut-off temperature, the temperature-sensitive control switch 14 opens the electrical energizing circuit thereby turning off the circulating fan 13 and the circulating pump 15. Thereafter, as long as temperature in the warming oven 2 remains below the turn-on temperature of 150° F., water does not circulate between the intermediate holding tank and the coil assembly 1. When the broiler 3 is again turned on and temperature within the warming oven reaches the turn-on temperature of 150° F., the circulating fan 13 and circulating pump 15 again begin to operate and again re-circulate water between the intermediate holding tank 16 and the coil assembly 1 to maintain water in the upper portion of the intermediate holding tank 16 at the desired intermediate raised temperature level.

I claim:

1. A heat exhanger comprising a coil assembly, an oven for heating food, said coil assembly being mounted in said oven, an intermediate water tank, said intermediate water tank including a first outlet port and a first inlet port, a first outlet conduit connected between said first outlet port of said intermediate water tank and said coil assembly, a return conduit connected between said coil assembly and said first inlet port of said intermediate water tank, a primary water tank, primary heating means to heat water in said primary water tank to a pre-determined end use temperature, said primary water tank including a primary inlet port and a primary outlet port, said intermediate water tank including a second outlet port and a second inlet port, a second outlet conduit connected between said second outlet port of said intermediate water tank and said primary inlet port of said primary water tank, a cold water conduit connected between said second inlet port of said intermediate water tank and a pressurized cold water supply source, a hot water conduit connected between said primary outlet port of said primary water tank and end use hot water dispensing means, a pump to circulate water from said first outlet port of said intermediate tank through said coil assembly and back to said intermediate water tank through said first inlet port thereof, pressure within said primary and intermediate water tanks being in equilibrium when each is filled, pressure within said intermediate water tank when filled being in equilibrium with said pressurized cold water supply source, whereby when a quantity of hot water at said end use temperature is drawn from said primary water tank substantially the same quantity of water automatically flows from said intermediate water tank to said primary water tank and substantially the same quantity of water flows from said pressurized cold water supply source into said intermediate water tank until both said water tanks are again filled and equilibrium of pressure between them is again reached, the temperature of water in said primary water tank being maintained continously at a higher end use temperature than water in said intermediate water tank which is heated by said coil assembly in said oven to an intermediate temperature level that is always below said end use temperature of the water in said primary water tank, said intermediate temperature level being maintained below said end use temperature by intermediate temperature limit means, said limit means including said coil assembly in said oven wherein said coil assembly comprises a preselected surface area and dimension to limit the heat taken up from said oven, and control means to operate said pump continuously to flow water continuously through said coil assembly from said intermediate water tank when the temperature in said oven is above a preselected level.

2. A heat exchanger as set forth in claim 1, wherein said oven is one in which the operating temperature is approximately five hundred degrees Fahrenheit, said coil assembly comprises ten one inch diameter pipes extending between said first outlet conduit connected at its opposite end to said intermediate water tank and said return conduit whose other end is also connected to said intermediate water tank.

3. A heat exchanger as set forth in claim 1, wherein said pipes of said coil assembly are spaced apart in said oven across a span of about twelve inches.

4. A heat exchanger as set forth in claim 1, wherein said control means includes a temperature sensitive control switch mounted to monitor the temperature within said oven, an electrical circuit connected to an electrical power source, said temperature sensitive control switch being connected to open and close said circuit, an electric motor in said circuit connected to operate said pump, said temperature sensitive control switch being adjusted to open said circuit and stop said motor and said pump when the temperature within said oven drops below about one hundred fifty degrees Fahrenheit and to close said circuit to operate said motor and said pump when the temperature in said oven rises above about one hundred fifty degrees Fahrenheit.

* * * * *